US006539596B1

(12) United States Patent
Hwo et al.

(10) Patent No.: US 6,539,596 B1
(45) Date of Patent: Apr. 1, 2003

(54) NONWOVENS FROM POLYTRIMETHYLENE TEREPHTHALATE BASED STAPLE FIBERS

(75) Inventors: Charles Chiu-Hsiung Hwo, Sugar Land, TX (US); Donald Albert Shiffler, Kinston, NC (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/960,202

(22) Filed: Sep. 21, 2001

Related U.S. Application Data

(60) Provisional application No. 60/235,047, filed on Sep. 25, 2000, and provisional application No. 60/287,357, filed on Apr. 30, 2001.

(51) Int. Cl.[7] ..... D04H 1/42; D04H 1/44

(52) U.S. Cl. ..... 28/104

(58) Field of Search ..... 28/103, 104, 105, 28/106, 167; 264/555, 172.19; 442/328, 329, 401, 408

(56) References Cited

U.S. PATENT DOCUMENTS

| | | | | | |
|---|---|---|---|---|---|
| 4,486,485 | A | * | 12/1984 | Sookne | 442/360 |
| 6,127,027 | A | * | 10/2000 | Nogami et al. | 442/417 |
| 6,316,101 | B2 | * | 11/2001 | Kato et al. | 428/364 |
| 6,322,604 | B1 | * | 11/2001 | Midkiff | 55/486 |
| 6,458,455 | B1 | * | 10/2002 | Hernandez et al. | 442/357 |
| 6,471,910 | B1 | * | 10/2002 | Haggard et al. | 264/172.17 |
| 2002/0025748 | A1 | * | 2/2002 | Rudisill | 442/400 |
| 2002/0037679 | A1 | * | 3/2002 | Bansal et al. | 442/415 |
| 2002/0071951 | A1 | * | 6/2002 | Hernandez et al. | 264/211.17 |

FOREIGN PATENT DOCUMENTS

| | | | |
|---|---|---|---|
| GB | 1254826 | 11/1971 | |
| JP | 11158733 | 6/1999 | D01F/8/14 |
| JP | 11189938 | 7/1999 | D02G/1/12 |
| JP | 2000220067 | 8/2000 | D04H/1/42 |
| WO | WO 01/07693 | 2/2001 | |

OTHER PUBLICATIONS

International Search Report of Jun. 24, 2002.

* cited by examiner

*Primary Examiner*—A. Vanatta
(74) *Attorney, Agent, or Firm*—Donald F. Haas

(57) ABSTRACT

This invention relates to making high quality, soft and relatively elastic nonwoven fiber webs from polytrimethylene terephthalate (PTT). Staple PTT fibers are first manufactured. Usually, this involves spinning the polymer into fibers and then cutting them to a length of from 10 to 200 millimeters. Thereafter, the fibers are carded and hydroentangled. This combination of steps produces high quality PTT nonwoven fabrics, i.e., which are softer than fabrics from other materials, require less energy to hydroentangle, can be manufactured at higher carding rates, and have a higher dye yield.

The staple polymers are first carded. This can be carried out in conventional carding machines such as roller top carding machines, layered carding machines, and flat top carding machines. The web is crosslapped to from 5 to 500 g/m$^2$ basis weight web. Next, the webs are hydroentangled. This can be carried out in conventional textile hydroentanglement apparatus including water jet injection, dewatering or vacuum boxes, a filtration, a water removing system, a perforating unit, drying, and winding. Special apparatus and process conditions for the hydroentanglement of PTT include lower water jet pressure needed than the normally used for PET and nylons.

6 Claims, 13 Drawing Sheets

NONWOVENS FROM POLYTRIMETHYLENE TEREPHTHALATE BASED STAPLE FIBERS

This application claims the benefit of U.S. Provisional Application No. 60/25,047 filed Sep. 25, 2000, and 60/287, 357 filed Apr. 30, 2001, the entire disclosure of which is hereby incorporated by reference.

FIELD OF THE INVENTION

This invention relates to the manufacture of nonwoven fabrics from polytrimethylene terephthalate (PTT) based staple fibers. More specifically, the present invention relates to a process for producing such nonwovens which involves forming the web by carding the PTT fibers and then mechanically binding them by hydroentanglement.

BACKGROUND OF THE INVENTION

As described in the 1987 Encyclopedia of Polymer Science and Engineering, Volume 10, page 204+, nonwoven fabrics are porous, textile-like materials, usually in flat sheet form, which are composed primarily or entirely of fibers assembled in webs. Nonwoven fabrics are manufactured by processes other than spinning, weaving, or knitting. The ASTM definition of nonwoven fabrics is "a structure produced by bonding or the interlocking of fibers, or both, accomplished by mechanical, chemical, thermal, or solvent means and the combination thereof." The biggest advantage of nonwoven fabrics is their cost to manufacture and that they are usually made directly from raw materials in a continuous production line which allows the manufacturer to eliminate a number of conventional textile operations.

Thin woven webs can be formed of most natural fibers, including wood pulp, cotton, and manila hemp. Rayon and cellulose acetate are also used. Presently, synthetic fibers including polyethylene terephthalate, nylon-6, nylon-6,6, polypropylene, and polyvinyl alcohol fibers are used in commercial nonwoven fabric manufacture.

Staple fibers are used as the raw material for the manufacture of nonwoven fabric webs. Staple fibers are fibers which are long enough to be used in conventional spinning equipment. Generally, the fibers are between 1.2 and 20 centimeters long, but some fibers may be longer than that. Dry processing methods, such as carding and air-laying, are used in the formation of the nonwoven web.

In carding, the webs are produced using conventional textile carding machines. Bales of staple fiber are opened by machines equipped with sharp teeth or needles to tear the fibers. This process is called picking. Clumps of staple fibers from the picking process are first separated mechanically into individual fibers and then formed into a coherent web in the carding machine which utilizes opposed moving beds of closely spaced needles to pull and tease the clumps apart. There is a large rotating metal cylinder covered with card clothing (comprised of needles, wires, or fine metallic teeth embedded in a heavy cloth or a metal foundation) at the center of the machine. The moving beds of needles are wrapped on or around the cylinder and narrow metallic flaps which are held on an endless belt moving over the top of the cylinder. The cylinder moves faster than the flats and the clumps between the two beds of needles are separated into individual fibers which are then aligned in the machine direction as each fiber is held at each end by individual needles from the two beds. The fibers engage each other randomly and form a coherent web.

After the web is formed, the fibers must be bonded in order to form a web with sufficient strength. Bonding can be carried out by both adhesive and mechanical means. Types of adhesive bonding include latex bonding, print bonding, spray bonding, foam bonding, and thermal bonding. Mechanical bonding utilizes frictional forces between the fibers and methods include hydro entanglement (spun lace, water punch), needle punching, and stitch bonding.

In the hydroentanglement process, high pressure water jets entangle the fibers. Usually, a staple fiber web is made on a perforated belt and is passed under high pressure water jets. The high pressure jets of water cause the fibers to migrate and entangle including to the perforation in the belt. The belt is then impregnated with binder in order to seal segments of the structure. U.S. Pat. No. 3,485,706 describes a hydroentanglement process for making nonwoven webs. This patent is herein incorporated by reference for the purpose of adding to the description of the present invention.

Japanese Public Patent Application JP 11089869A describes a composite structure having air permeability which is formed by laminating a thermoplastic synthetic resin film onto a nonwoven fabric consisting of PTT fiber. PTT was used because the final product was softer and better in elasticity than polypropylene, polyethylene terephthalate (PET), or polyamides (PA or nylon). The recommended method for making the nonwoven fabric is spun bonding, in which fibers and web are made simultaneously directly from the bulk polymer. The bulk polymer is melted, extruded, and drawn to filaments that are randomized and deposited onto belts as a continuous virtually endless web. The melted polymer is forced through very fine holes in a special die into a high velocity air stream wherein the polymer is formed to very fine, although irregular, filaments of indeterminate lengths. The reference generally states that other methods, such as carding, can be used to make the web and that the web can be further treated by other methods, including hydroentanglement, although no details are provided.

SUMMARY OF THE INVENTION

This invention relates to making high quality, soft and relatively elastic nonwoven fiber webs from polytrimethylene terephthalate (PTT). Staple PTT fibers are first manufactured. Usually, this involves spinning the polymer into fibers and then cutting them to a length of from 10 to 200 millimeters, preferably 25 to 80 mm, and a fiber weight of 0.1 to 20, preferably 0.5 to 10, deniers per filament;. Thereafter, the fibers are carded and hydroentangled. This combination of steps produces high quality PTT nonwoven fabrics, i.e., which are softer than fabrics from other materials, require less energy to hydroentangle, can be manufactured at higher carding rates, and have a higher dye yield.

The PTT staple fibers are first carded. This can be carried out in conventional carding machines wherein the web is crosslapped at a belt speed of up to 1000, preferably 10 to 1000, most preferably 100 to 300, meters per minute, a cross lap of wet of 1 to 50 layers, preferably 3 to 10, and a web weight of 5 to 500 g/m$^2$, preferably 10 to 100, in a carding machine selected from the group consisting of roller-top, flat-top, and layering types. The web is mechanically bonded the web by hydroentanglement at a belt speed of up to 500 meters per minute, preferably 5 to 500, most preferably 50 to 200, with from 1 to 10 multiple passes and a water jet hydraulic pressure of 1 bar to 500 bar (100 to 50000 kPa). Our process requirements for the carding are: Carding at 3 meters/minutes to give a target web weight of 50 g/m$^2$ with 8 layers of crosslapping.

Hydroentanglement can be carried out in conventional textile hydroentanglement apparatus including water jet injection, dewatering or vacuum boxes, a filtration, a water removing system, a perforating unit, drying, and winding. Special apparatus and process conditions for the hydroentanglement of PTT include lower water jet pressure needed than the normally used for PET and nylons.

DETAILED DESCRIPTION OF THE INVENTION

Figure 1:
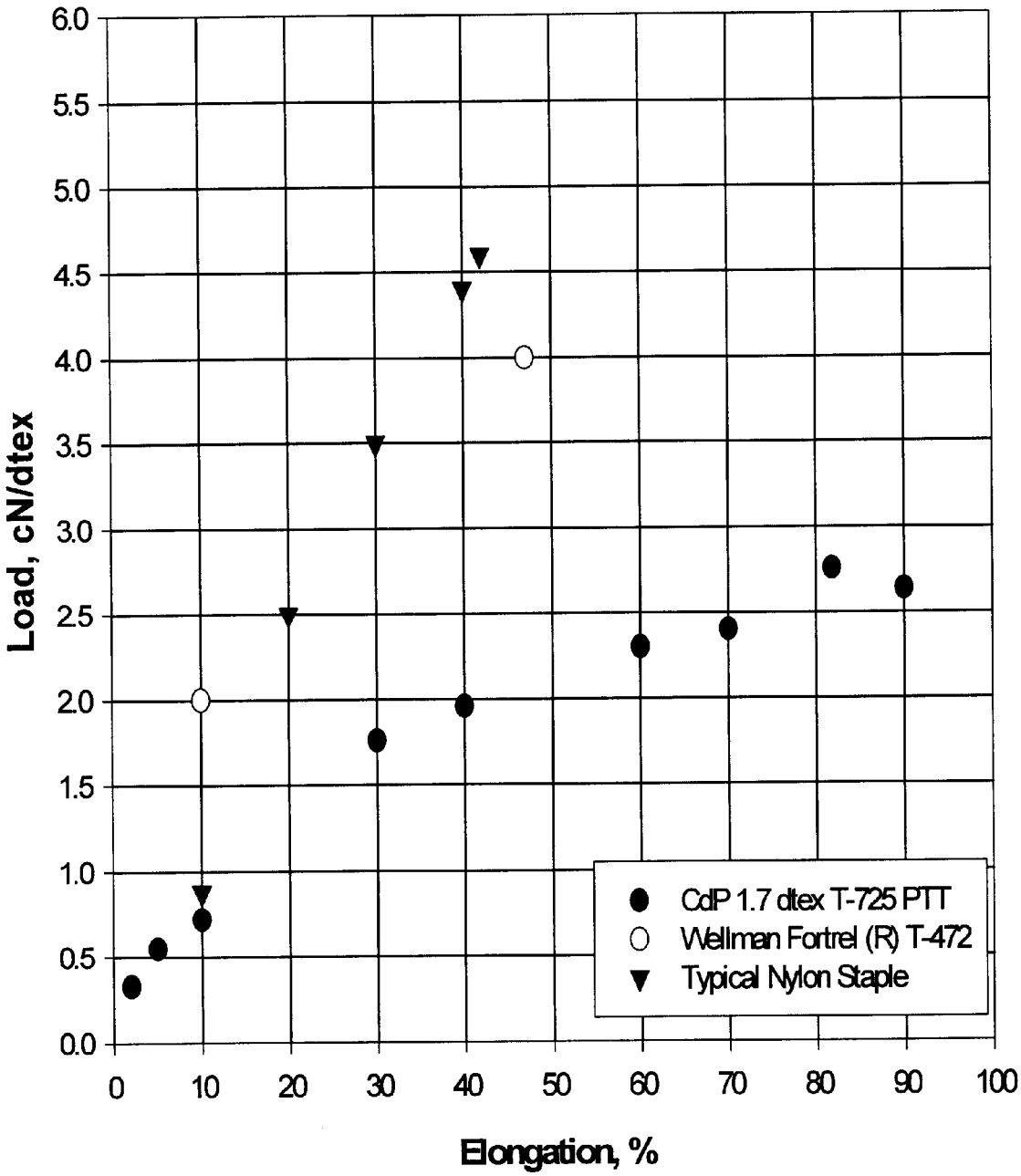
FIG. 1 shows the stress strain curves for the three test fibers used in the examples.

There are a number of different types of mechanical carding machines that are used in the textile industry. Roller-top, flat-top, and layer carding machines can be used in the present invention for PTT and blends of PTT and PET The general processing conditions and steps under which the carding machines can be used are as follows: Bales of staple fiber are opened by machines equipped with sharp teeth or needles to tear the fibers. This process is called picking. Clumps of staple fibers from the picking process are first separated mechanically into individual fibers and then formed into a coherent web in the carding machine which utilizes opposed moving beds of closely spaced needles to pull and tease the clumps apart. There is a large rotating metal cylinder covered with card clothing (comprised of needles, wires, or fine metallic teeth embedded in a heavy cloth or a metal foundation) at the center of the machine. The moving beds of needles are wrapped on or around the cylinder and narrow metallic flaps which are held on an endless belt moving over the top of the cylinder. The cylinder moves faster than the flats and the clumps between the two beds of needles are separated into individual fibers which are then aligned in the machine direction as each fiber is held at each end by individual needles from the two beds. The fibers engage each other randomly and form a coherent web For hydroentanglement, the general processing conditions and steps under which the hydroentanglement according to the present invention may be carried out are as follows: High pressure water jets entangle the fibers. Usually, a staple fiber web is made on a perforated belt and is passed under high pressure water jets. The high pressure jets of water cause the fibers to migrate and entangle including to the perforation in the belt. The water pressure used to achieve the entanglement may vary from 1 to 500 bar (100 to 50000 kPa), preferably 5 to 250 bar (500 to 25000 kPa). The formed entangling web are dewatered by suction boxes located immediately under the conveying element and corresponding to the jet manifolds. The web is dried by passing through a set of heated calendar rolls Following hydroentanglement, the web is finished in order to provide a commercially saleable product. The following treatment steps may include spraying of adhesives and fabric softener. These webs can be used for wiping, wall paper and draperies, interlining fabrics, cotton bale bags, and many others as developed.

Key properties of PTT polymer are compared with other thermoplastics used in nonwoven fiber production in Table I.

TABLE I

Thermoplastics Used in Fiber Production

| | PTT | PET | Nylon 6 | Nylon 6,6 | PP |
|---|---|---|---|---|---|
| Melting Point ° C. | 228 | 265 | 220 | 265 | 168 |
| Glass Transition, ° C. | 45–65 | 80 | 40–87 | 50–90 | −17 to −4 |
| Density (g/cm$^3$) % Water | 1.33 | 1.40 | 1.13 | 1.14 | 0.91 |
| Absorption (24 hours) | 0.03 | 0.09 | 1.9 | 2.8 | |
| % Water Absorption (14 days) | 0.15 | 0.49 | 9.5 | 8.9 | <0.03 |

PTT Properties Impacting Nonwovens

The stress strain curve for the PTT staple used in this work is compared to that of the Fortrel® T-472 PET fiber which was used and a typical nylon 6,6 staple fiber in FIG. 1. PTT has several unusual features which we initially felt could be important to nonwoven technology:

Its elongation to break is significantly larger than either PET or nylon, promising improved tear strength Its initial modulus is lower than either control fiber, which results in reduced bending rigidity and hence a softer, more easily hydroentangled fiber.

In the nonwoven context we expected PTT to provide a softer fabric and require less energy to hydroentangle. We felt there would be other advantages including potential for higher carding rates and higher dye yield. PTT has also been shown to have very high recovery after compression in part because it has high fiber crimp retention. For example, if the bulk of slivers, which have been carded and drawn three times, are compared at a constant pressure of 5 cN/cm$^2$, we find that PTT has a considerably higher specific volume than PET. This bulk advantage for PTT persists in spite of its lower bending rigidity. We felt that this would lead to a soft feeling, high bulk nonwoven.

The examples show the effects of these fiber properties on hydroentanglement efficiency and tensile, tear, and flexile rigidities of hydroentangled fabrics. The fibers used in this study are summarized in Table II.

TABLE II

| Fiber | Dtex* | Length, mm | Source |
|---|---|---|---|
| PTT | 1.7 | 38 | CdP Type 725 Semi Dull Unwhitened |
| PET | 1.7 | 38 | Wellman T-472 Semi Dull Optically Brightened |
| Nylon | 1.7 | 40 | Rhodia, Type R174 Matt Dull |

*A unit for expressing linear density

EXAMPLES

All experiments were performed in the Nonwoven Cooperative Research Center's laboratory/pilot plant at the North Carolina State University, Raleigh, N.C. which has carding, hydroentangling, needle punch, and thermal bonding equipment. The first set of experiments used a 10% PET, 90% PTT blend web prepared on a roller top card which was cross lapped to a 60 g/m$^2$ basis weight web. All other fiber blends were carded on a flat top card and cross lapped to 50 g/m$^2$ web weight. Webs were tacked for integrity and wound on spindles for further processing. A 50 cm web width was used for all experiments.

A roller top carding machine was used on the staple blend of 90% PTT and 10% PET (1.7 dtex and 38 mm cut length) supplied by Wellman. Eight carded webs were successfully produced at 60 g/m$^2$. The 90% PTT/10% PET carded webs were hydroentangled with two different sizes of supporting meshes (1. 100 and 2. 12×10) successfully. Three hydro heads were applied. Pressures were varied (200 to 1050 psi; 1379 to 7240 kPa). A total of 6 samples were produced for each mesh size. The carded webs were thermal pointed bonded at temperatures staring at 130° C. and up to 192° C. at three different pressures (100, 300, and 500 pli [pounds per linear inch]; 8.9, 26.6, and 44.3 N/linear cm). It appears bonding was not significant until 180° C.

A flat top carding machine by Signa Corp. was used to card the 100% PET staples successfully at 50 g/sq. m. web weight (Sample S2). Next a 50% PET +50% Nylon (1.2 dtex, 38 mm) blend was carded also successfully at 50 g/sq. m (Sample S3). Next, a 50% PET +50% PTT (1.2 dtex, 38 mm) blend was carded and successfully at 50 g/sq. m (Sample S4). A 100% Nylon (1.2 dtex, 38 mm) blend was carded and successfully at 50 g/sq. m (Sample S5). Last, carding of the staple of 100% PTT (Sample S6) was carried out. After going through the calendars, webs are laid 8 layers required to achieve the target 50 g/sq. m web weight at 12 ft/min. (3.66 m/min.) at the transfer station. Carded samples are summarized as in Table III.

TABLE III

| Samples ID | Material Composition | Carding method |
|---|---|---|
| S2 | 100% PET | Flat Top |
| S3 | 50% PET + 50% Nylon | Flat Top |
| S4 | 50% PET + 50% PTT | Flat Top |
| S5 | 100% Nylon | Flat Top |
| S6 | 100% PTT | Flat Top |

Hydroentanglement was carried out on a custom made apparatus/equipment in the NCRC's lab. The hydroentanglement conditions are summarized in Table TV.

TABLE IV

Hydroentanglement Variables

| Variable | Range Investigated |
|---|---|
| Jet Density | 15.8 jets/cm |
| Jet Diameter | 0.127 mm |
| Discharge Coefficient | 0.7 |
| Number of Manifolds/Pass | 3 |
| Number of Passes/Trial | 2 with sides reversed |
| Speed | 1.13 m/min |
| Pressure Range | 6.9–72.4 bar (690–72400 kPa |
| Low Aperture Forming Screen | 100 mesh |
| High Aperture Forming Screen | 12 × 14 mesh |

All of the fabrics were characterized in a similar manner. Tensile testing used ASTM 5035-90 and tested a 25.4 mm wide strip with a 76.2 mm gauge. Flexile rigidity was determined using IST 90.1. Tear strength used the trapezoid tear method ASTM D5733-95. All strength data was normalized to the average basis weight for the set under consideration. To simplify the analysis MD and CD results were averaged.

Hydroentanglement Results

Figure 2:
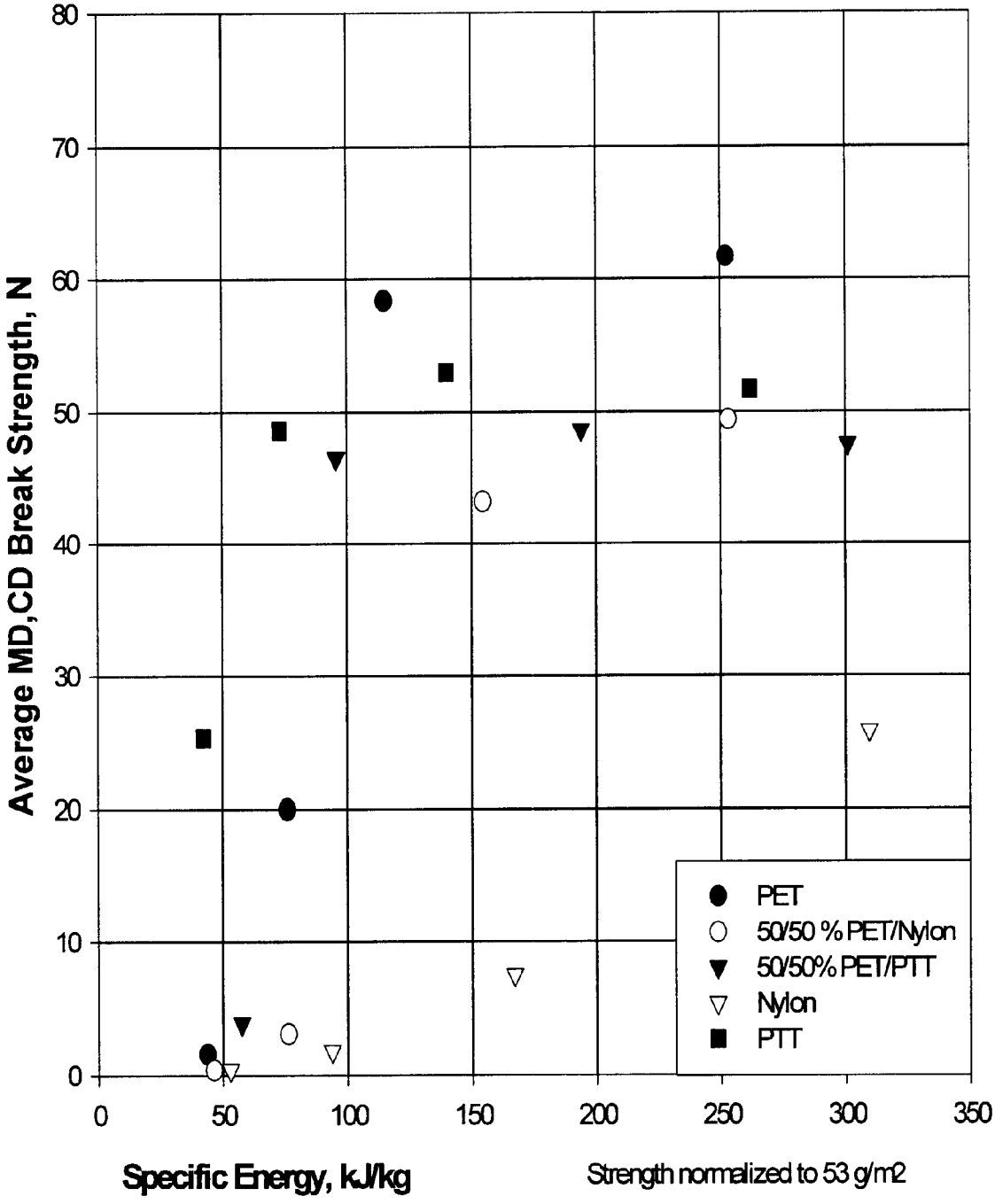
FIG. 2 shows the effect of specific energy on fabric break strength for a 100 mesh screen for five of the polymers tested.

In the first experiment, the 90% PTT/10% PET fabric achieved significant tear strength at 40 kJ/kg specific energy and there is little consistent effect of forming screen type on tear strength (FIG. 2).

The initial experiment was extended to the five additional blends of the fiber types summarized in Table II.

100% PET

50/50% PET/Nylon

50/50% PET/PTT

Nylon

PTT

Break Strength

Figure 3:
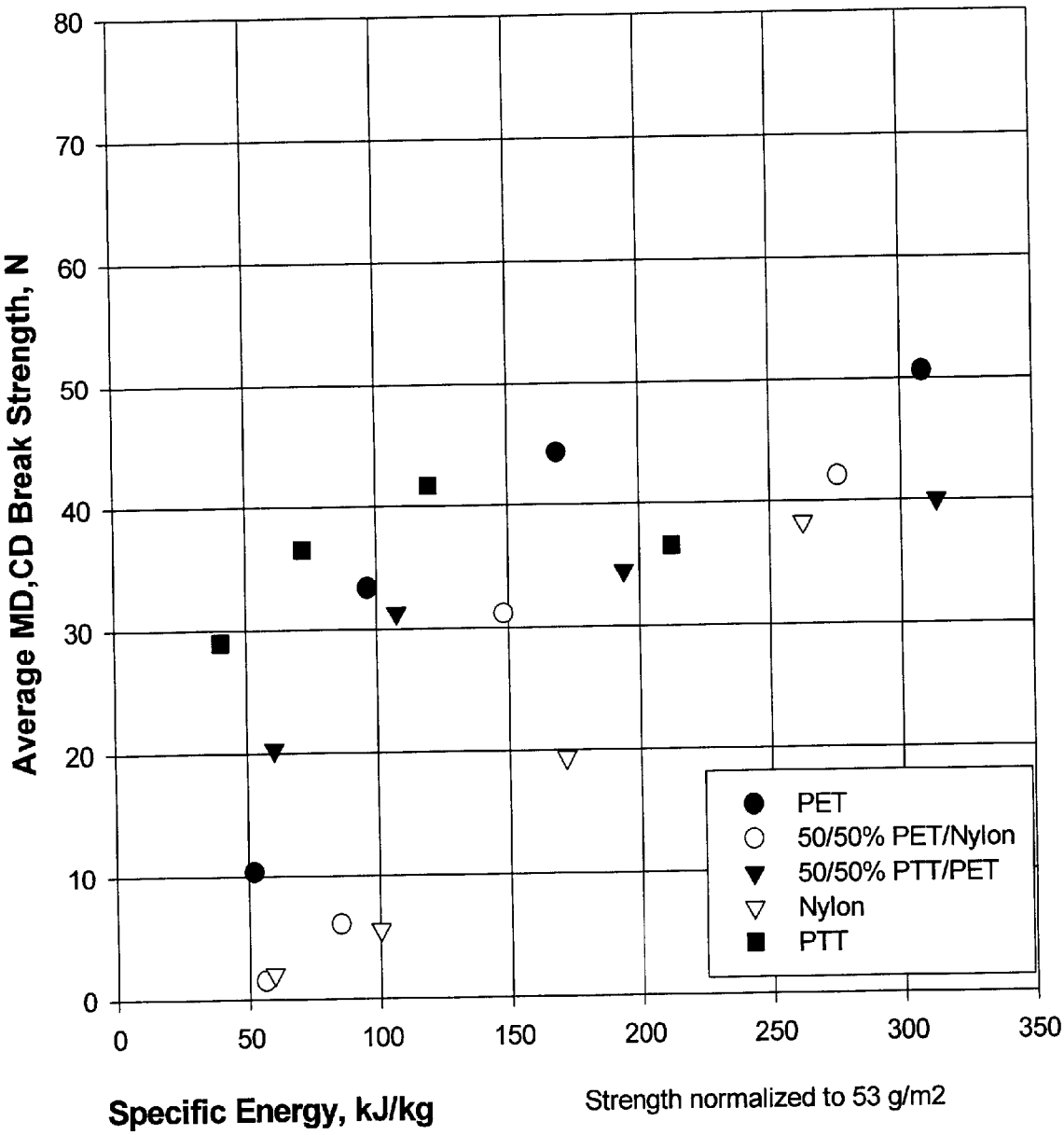
FIG. 3 shows the effect of specific energy on fabric break strength for the same fibers for a 12 by 14 mesh screen.

All fibers tested, except nylon, exhibited the same response to increasing specific energy. An initial rapid increase in break strength was followed by a plateau where increasing energy did little to increase break strength. The nylon sample was the exception with strength increasing nearly linearly with specific energy. Results are illustrated on FIGS. 2 and 3.

The threshold energy required to reach the break strength plateau is less for PTT containing blends. Table V lists the lowest energy required to reach the plateau for both meshes and the blends tested. Table VI lists the break strength the lowest energy required to reach the strength plateau. PTT is competitive in strength with the other blends, and requires significantly lower energy.

TABLE V

Specific Energy Required to Reach Break Strength Plateau

| Fiber Blend | 100 Mesh Screen, kJ/kg | 12 × 14 Mesh Screen, kJ/kg |
|---|---|---|
| PET | 120 | 320+ |
| 50/50% PET/Nylon | 200 | 270+ |
| 50/50% PET/PTT | 90 | 320+ |
| Nylon | 320+ | 270+ |
| PTT | 75 | 120 |

TABLE VI

| Break Strength at Plateau Specific Energy | | |
|---|---|---|
| Fiber Blend | 100 Mesh Screen, N | 12 × 14 Mesh Screen, N |
| PET | 58 | 51 |
| 50/50% PET/Nylon | 48 | 42 |
| 50/50% PET/PTT | 47 | 40 |
| Nylon | 26 | 38 |
| PTT | 49 | 42 |

Flexile Rigidity

Figure 4:
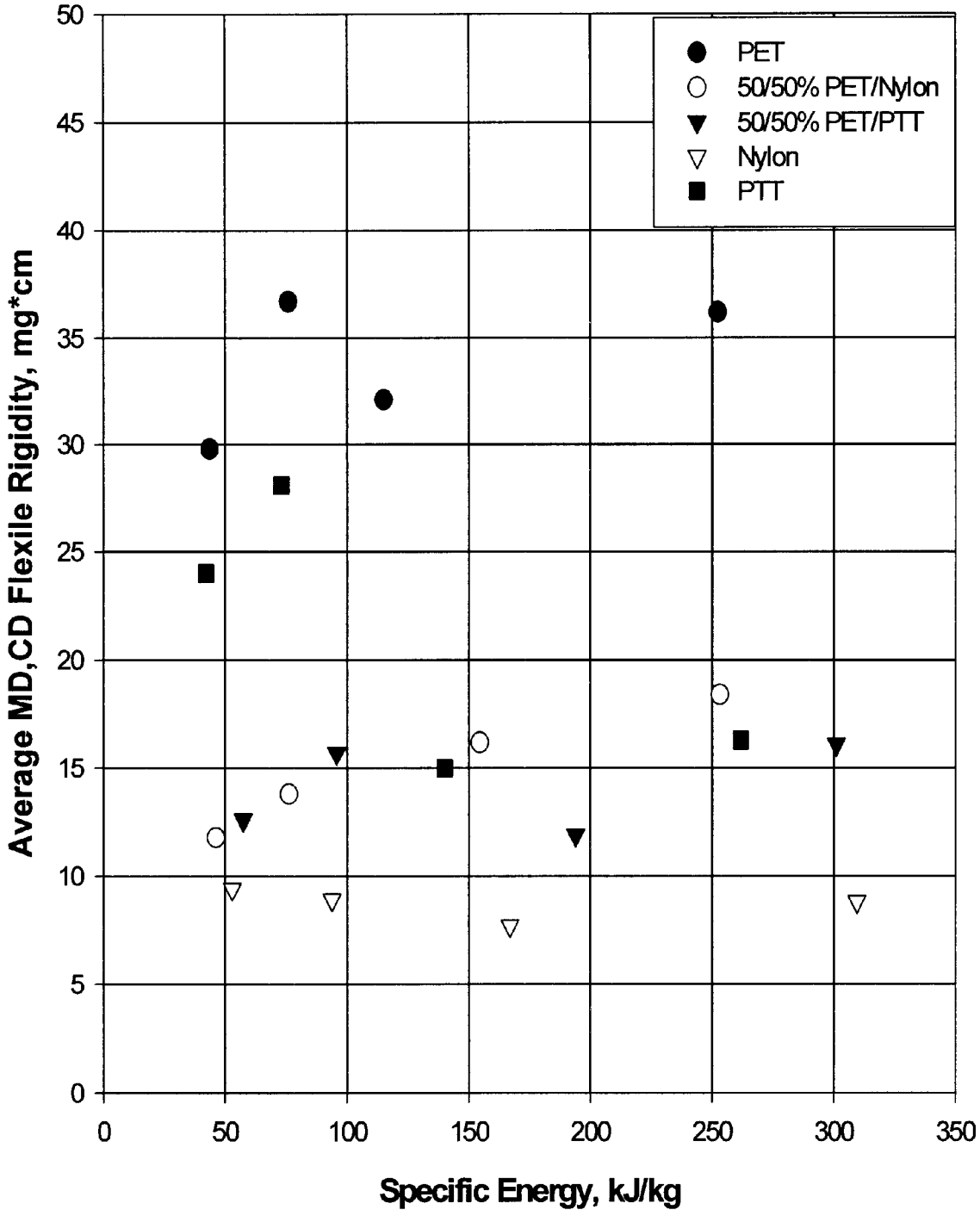
FIG. 4 shows the effect of specific energy on flexile rigidity for a 100 mesh forming screen.
Figure 5:
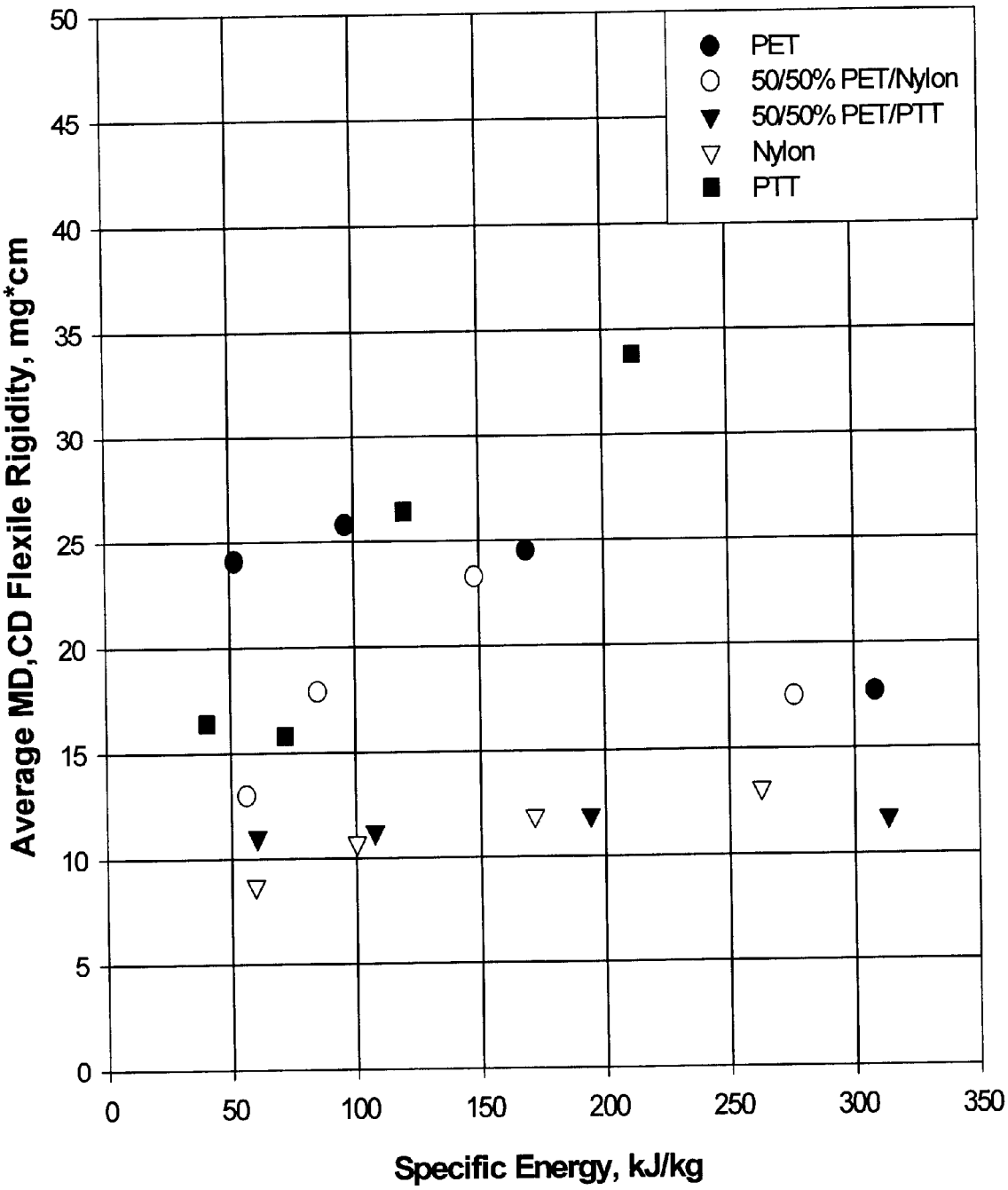
FIG. 5 shows the effect of specific energy on flexile rigidity for a 12 by 14 mesh screen.

Flexile rigidity results for both low and high aperture forming screens presented in FIG. 4 and 5 indicate that flexile rigidity is relatively independent of specific energy for all fibers tested. Flexile rigidity for PTT was somewhat higher than expected given the fiber's low bending rigidity, but the PTT fabrics tended to be higher weight because they are more easily consolidated by the jets.

Overall the flexile rigidity ranking for the 100 mesh screens in order of decreasing rigidity are:

PET

PTT

PET/Nylon

PET/PTT

Nylon

Overall the flexile rigidity ranking for the high aperture 12×14 mesh screens is:

PET and PTT (Tie)

PET/Nylon

PTT/PET and Nylon (Tie)

Tear Strength

Figure 6:
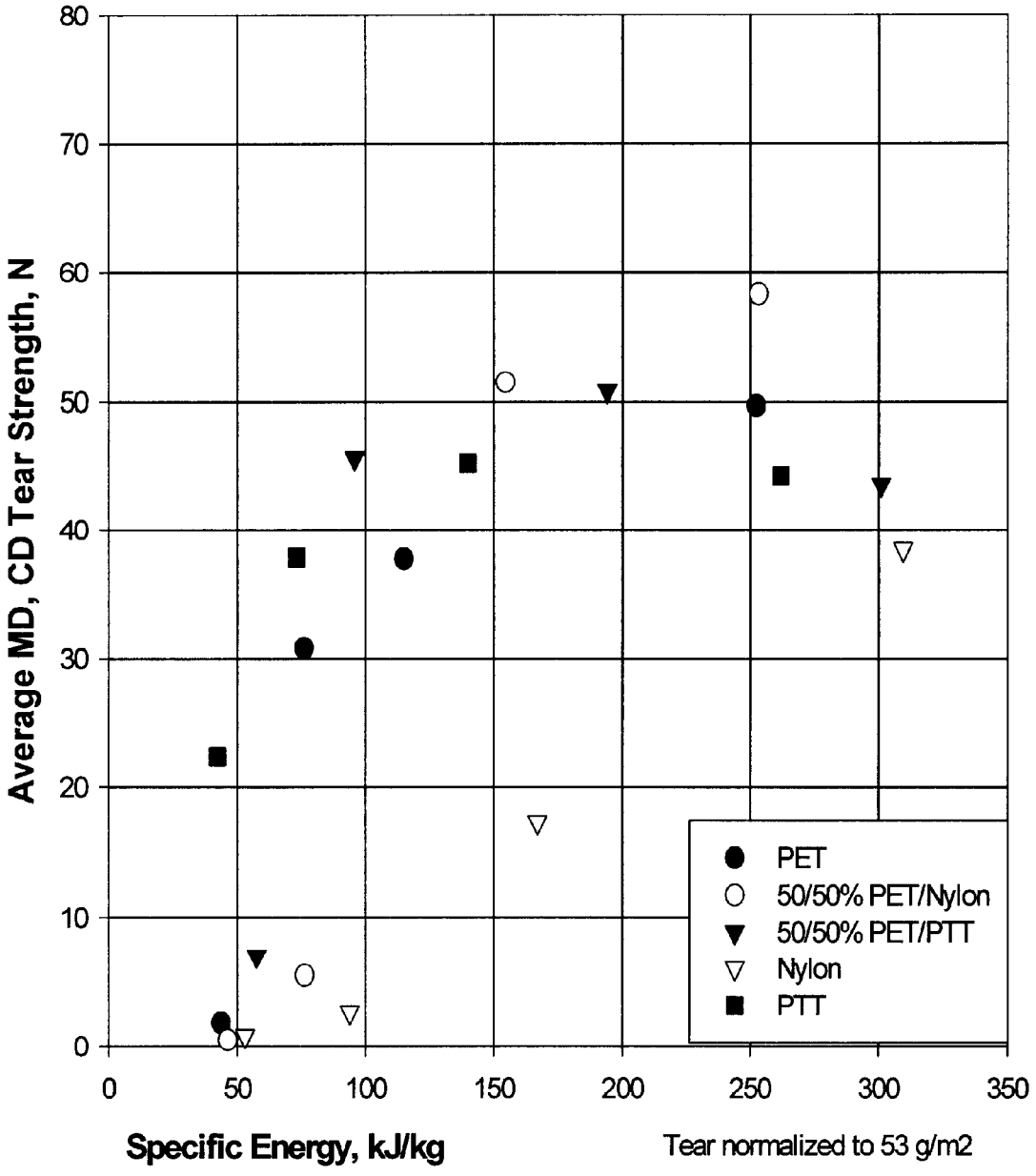
FIG. 6 shows the effect of specific energy on tear strength for a 100 mesh screen.
Figure 7:
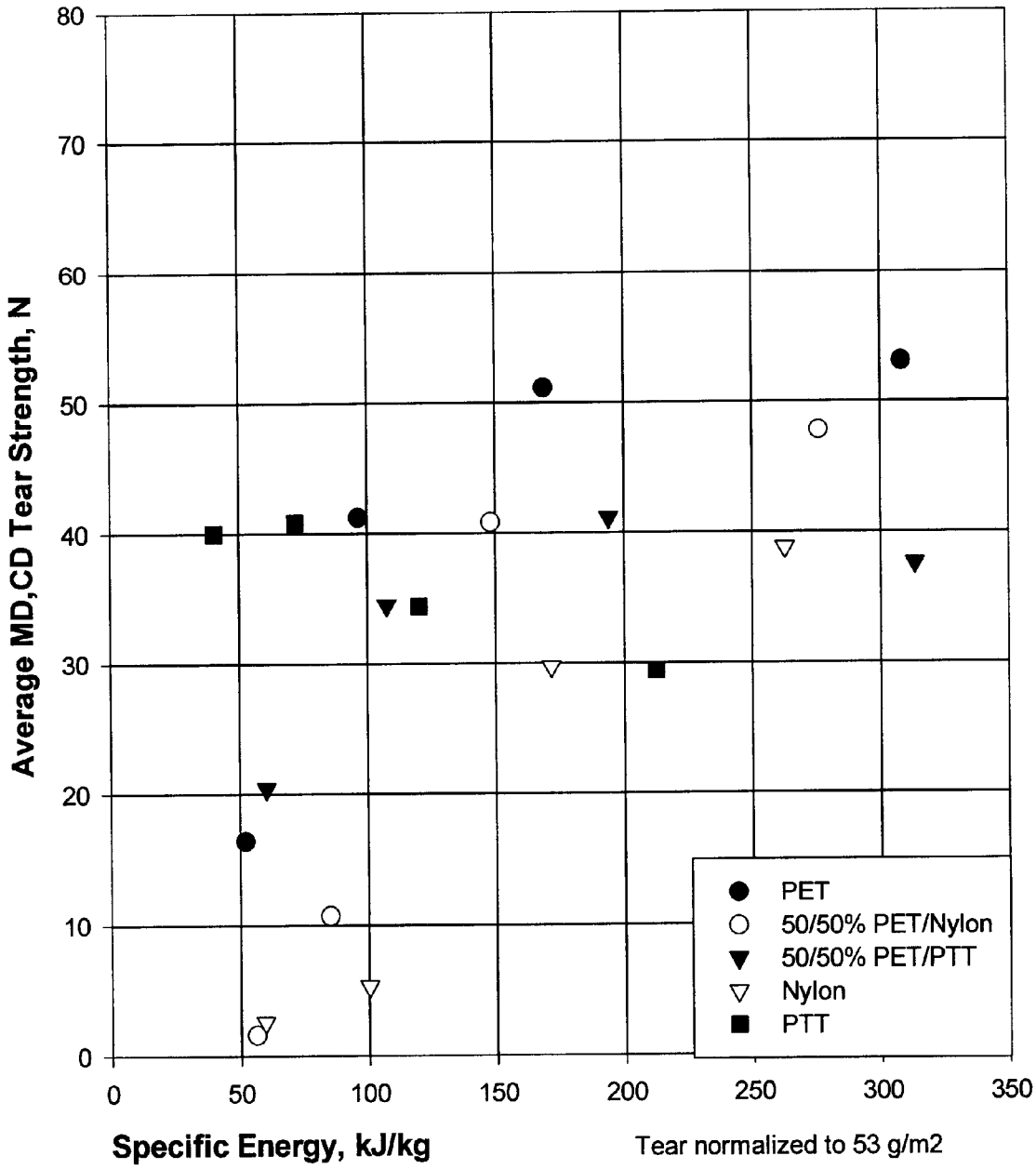
FIG. 7 shows the effect of specific energy on tear strength for a 12 by 14 mesh screen.

As specific energy increases, tear strength increases rapidly until a plateau value is reached where further energy increases provide no significant additional strength benefit. This behavior (FIGS. 6, 7) is completely analogous to the effect observed for tensile strength. Table VII presents the plateau energy for each fiber tested. Table VIII presents the tear strength at the plateau energy. PTT containing blends provide competitive tear strength at significantly lower energy levels.

TABLE VII

| Specific Energy Required to Reach Tear Strength Plateau | | |
|---|---|---|
| Fiber Blend | 100 Mesh Screen, kJ/kg | 12 × 14 Mesh Screen, kJ/kg |
| PET | 250+ | 170 |
| 50/50% PET/Nylon | 250+ | 280+ |
| 50/50% PET/PTT | 100 | 190 |
| Nylon | 300+ | 260+ |
| PTT | 130 | 50 |

TABLE VIII

| Tear Strength at Plateau Specific Energy | | |
|---|---|---|
| Fiber Blend | 100 Mesh Screen, N | 12 × 14 Mesh Screen, N |
| PET | 50 | 52 |
| 50/50% PET/Nylon | 58 | 48 |
| 50/50% PET/PTT | 46 | 41 |

TABLE VIII-continued

| Tear Strength at Plateau Specific Energy | | |
|---|---|---|
| Fiber Blend | 100 Mesh Screen, N | 12 × 14 Mesh Screen, N |
| Nylon | 39 | 48 |
| PTT | 45 | 40 |

Break Strength—Flexile Rigidity Tradeoff

Figure 8:
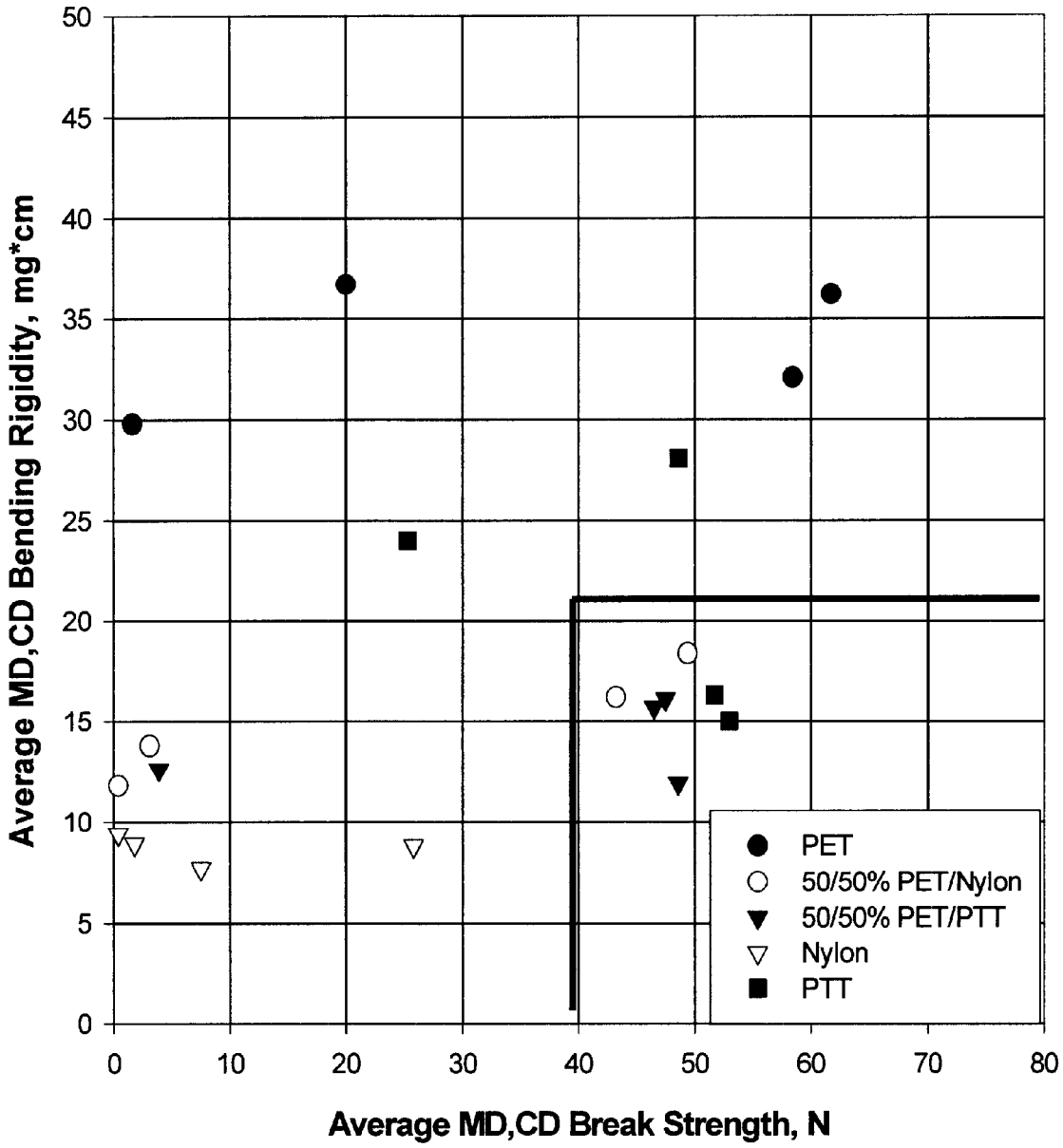
FIG. 8 shows the break strength—flexile rigidity tradeoff for a 100 mesh screen.
Figure 9:
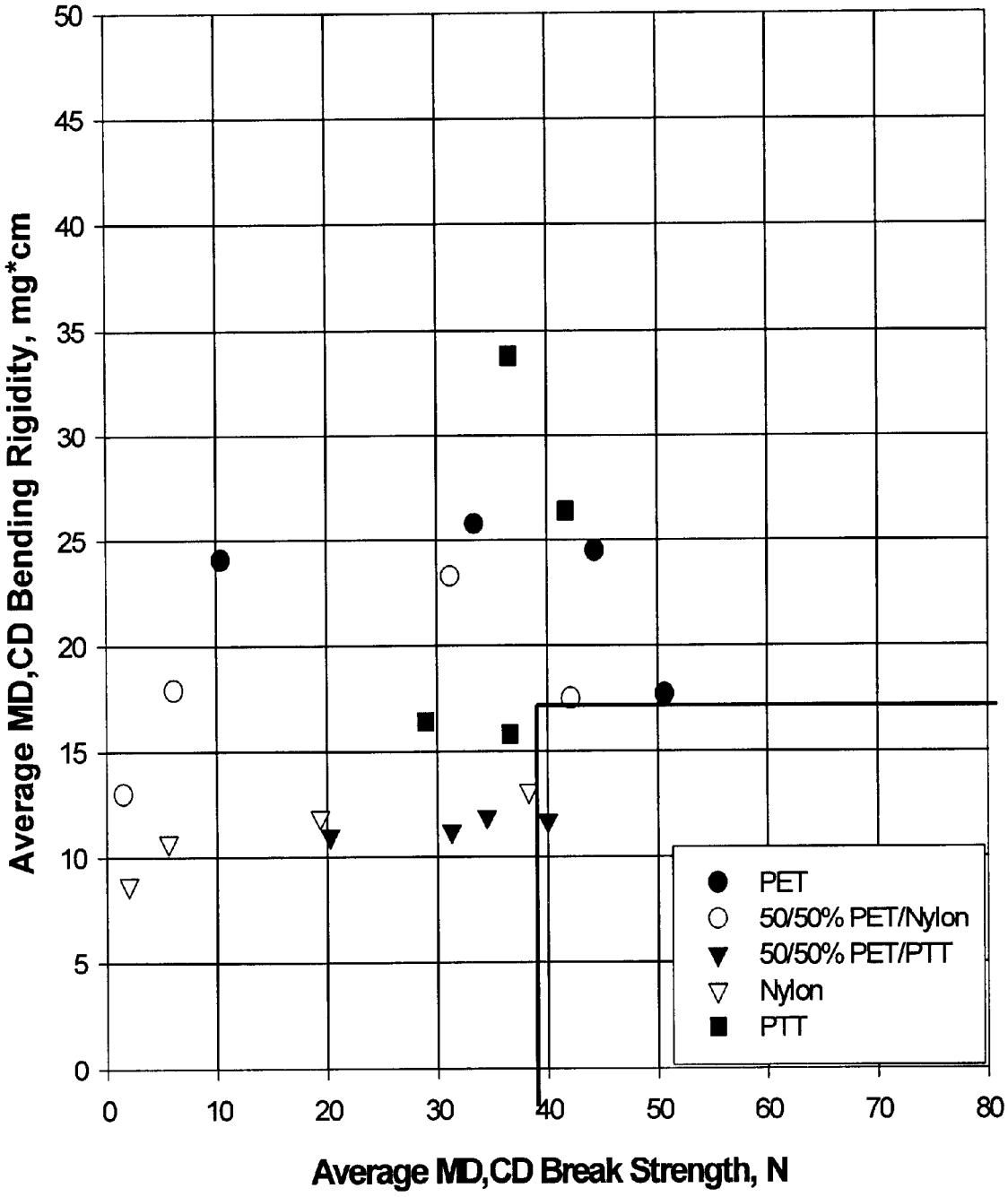
FIG. 9 shows the break strength—flexile rigidity tradeoff for a 12 by 14 mesh screen.

The ideal fabric would have high tensile and tear strength and low flexile rigidity. In practice this often involves a balance between high strength and increased flexile rigidity, and lack of drape. FIGS. 8 and 9 are cross plots of break strength and bending rigidity. The desired fabric is located in the lower right hand corner of this plot. When the preferred region is defined as flexile rigidity <20 mg*cm and break strength >40N, 5 of the 7 low aperture (100 mesh) fabrics in this region contain PTT. For the coarse aperture (12×14) fabrics 1 of 3 goal fabrics contain PTT.

Figure 10:
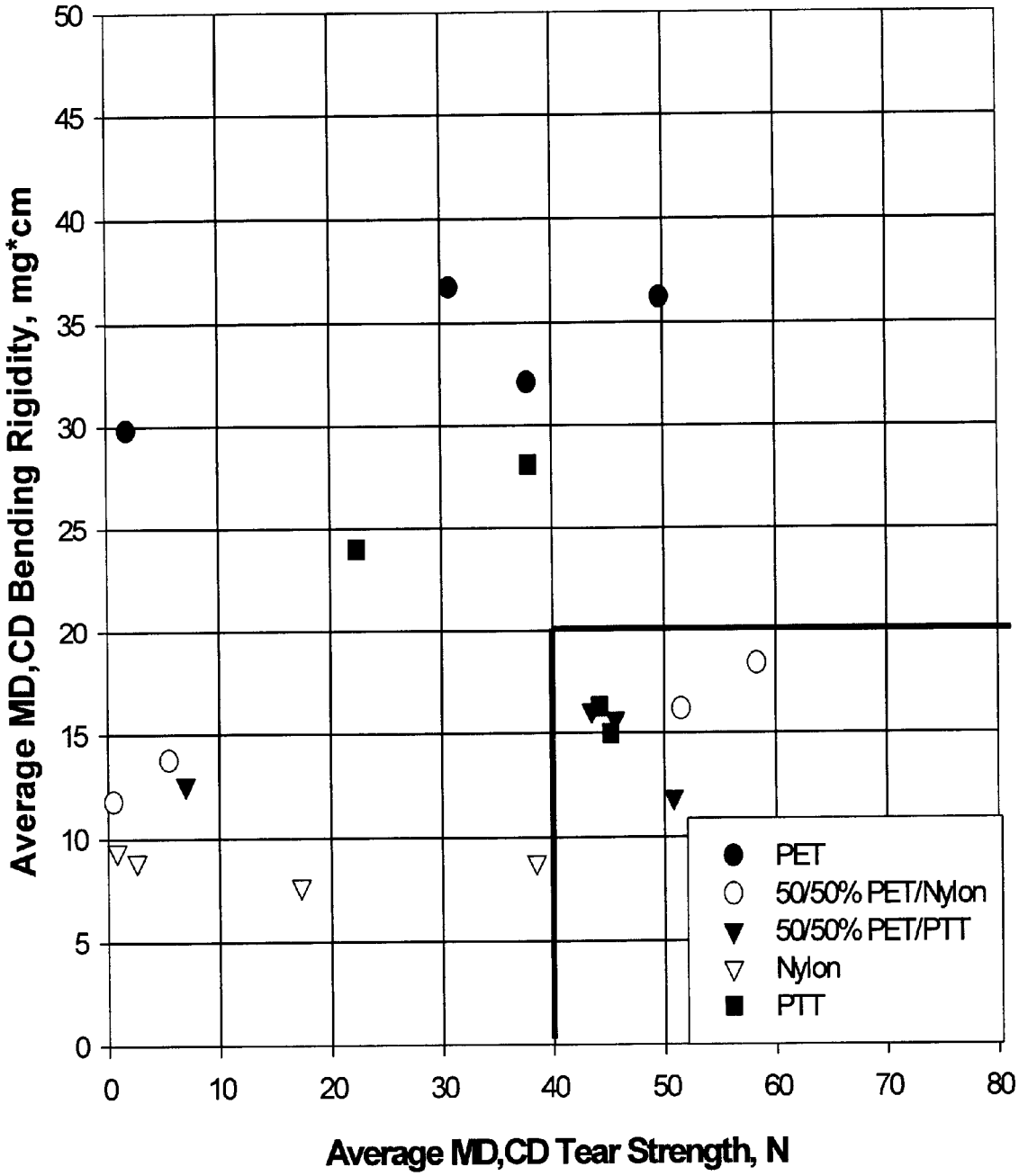
FIG. 10 shows-the tear strength—bending rigidity tradeoff for a 100 mesh screen.
Figure 11:
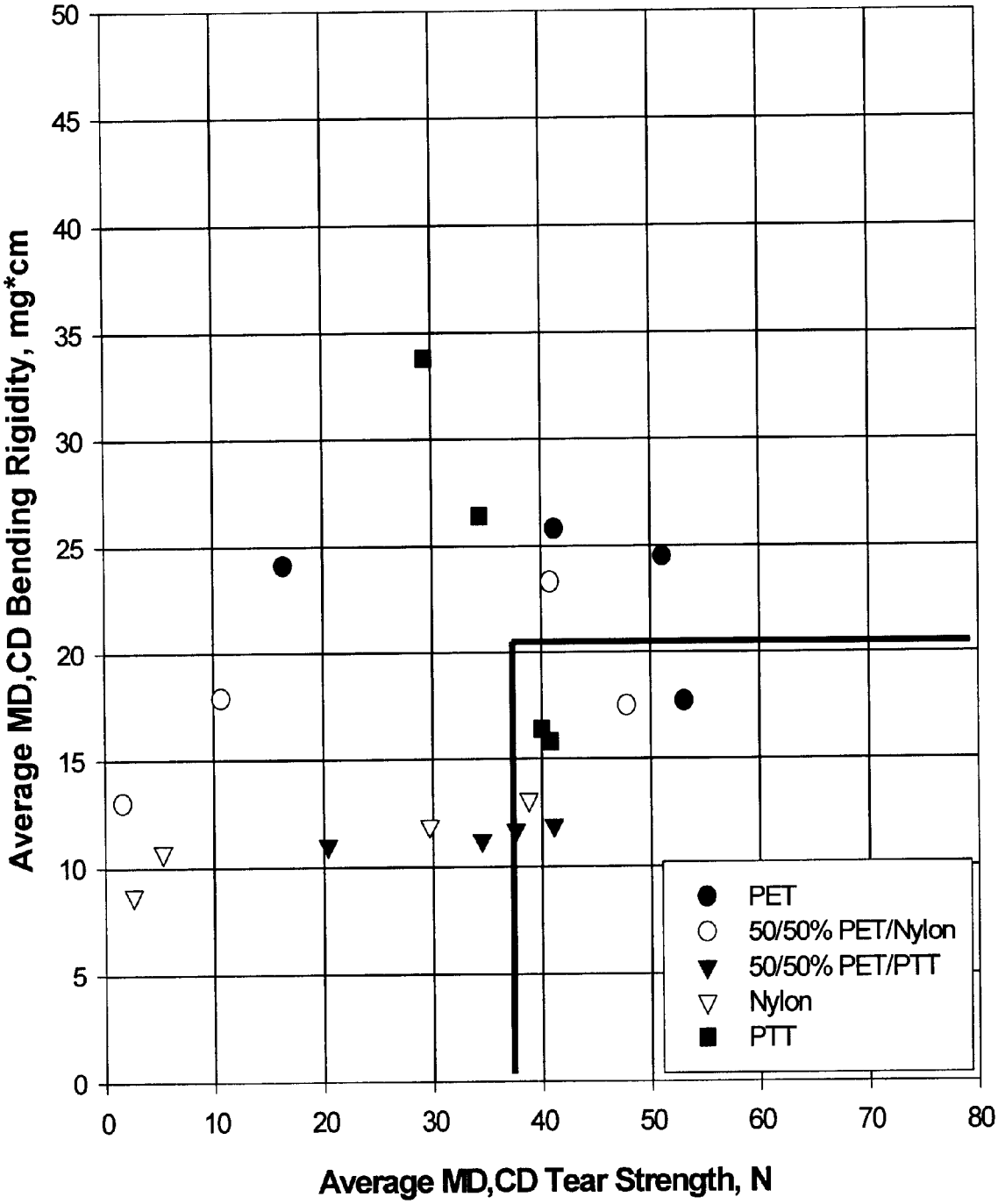
FIG. 11 shows the tear strength—bending rigidity tradeoff for a 12 by 14 mesh screen.

FIGS. 10 and 11 illustrate the tear strength, flexile rigidity balance for all fiber types tested. Again, arbitrarily defining the desired area as <20 mg*cm rigidity and >40 N tear strength, 5 of 7 fabrics in the goal area for the 100 mesh screen contain PTT and 3 of 5 fabrics for the high aperture 12×4 mesh screen contain PTT.

We conclude from the foregoing that PTT will provide a more drapeable fabric with good strength compared to the other fibers tested. Drape describes the way a fabric falls as it hangs and the suppleness and ability of a fabric to form graceful configurations.

Fabric Softness

When one touches and rubs the surface of a fabric, fibers that bend easily generally feel softer. For example, fabrics containing a microfiber generally feel much softer than the same polymer substrate at a higher dtex. Not surprisingly, hydroentangled fibers containing PTT are generally rated softer to the touch. Results of an informal tactile testing of fabrics from this set of experiments resulted in the following ranking, from high softness to low softness: PTT >Nylon >50/50% PET/PTT >50/50% PET/Nylon >PET We conclude from the foregoing that PTT will provide a softer, more pleasing fabric aesthetic. Because of its inherent low fiber bending rigidity in hydroentangled fabrics PTT provides the following characteristics:

Significant break strength develops at very low specific energy levels (80 kJ/kg).

Significant break strength develops at <50 kJ/kg.

Flexile rigidity does not increase with specific energy.

Significant tear strength develops at 40 kJ/kg

When compared to PET, Nylon, and PET/Nylon blends, PTT containing fibers have comparable tensile strength, tensile elongation, and tear strength at significantly lower input energy levels. In addition PTT provides a favorable strength/flexile rigidity balance which should yield a more drapeable fabric. PTT fabrics are rated softer than the other blends in subjective aesthetic testing.

Recovery and Strength vs. Flexibility of Hydrolace Nonwovens

Figure 12:
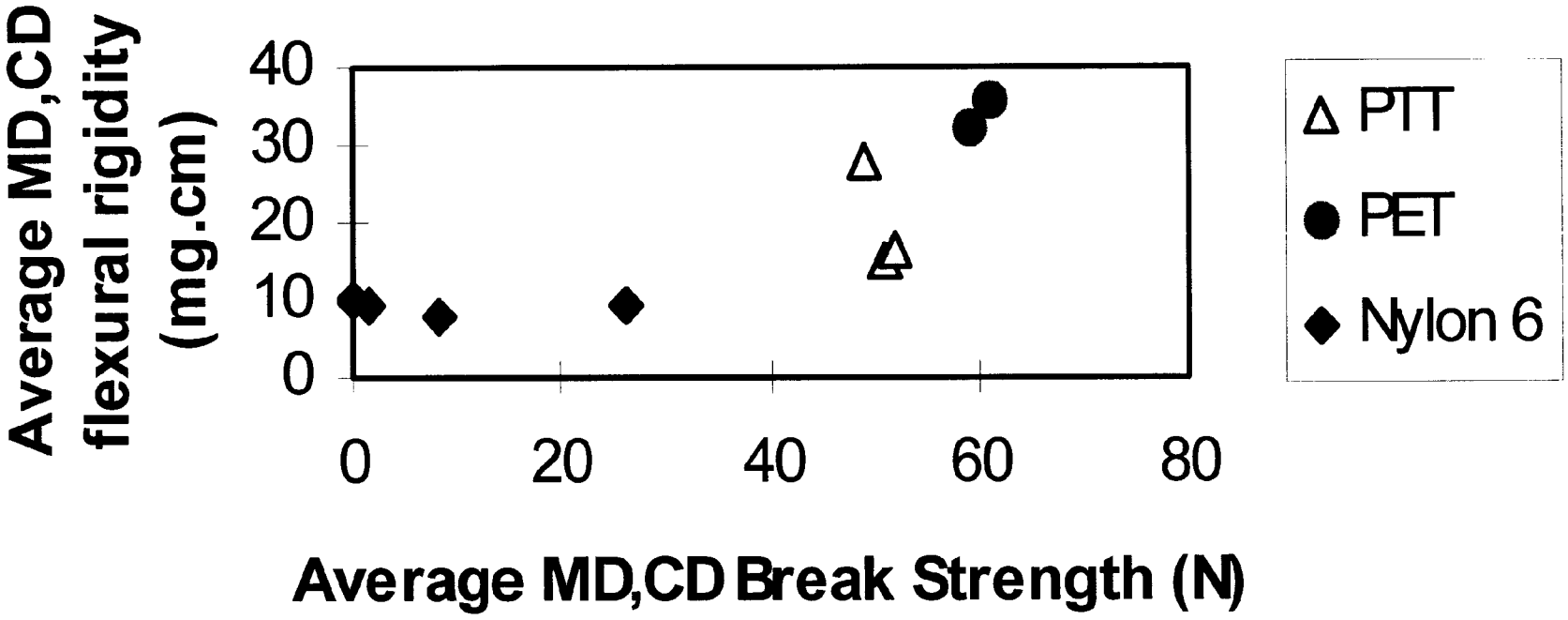
FIG. 12 shows the strength versus flexibility of hydroentangled nonwovens for PTT, PET, and nylon-6.

FIG. 12 gives a comparison of similar hydroentangled fabrics made from nylon 6 and PET staple fibres, as well as PTT in terms of strength, elongation, and flexural rigidity. PTT has a good balance of strength achievable (above the threshold level) and rigidity as shown in FIG. 12.

Figure 13:
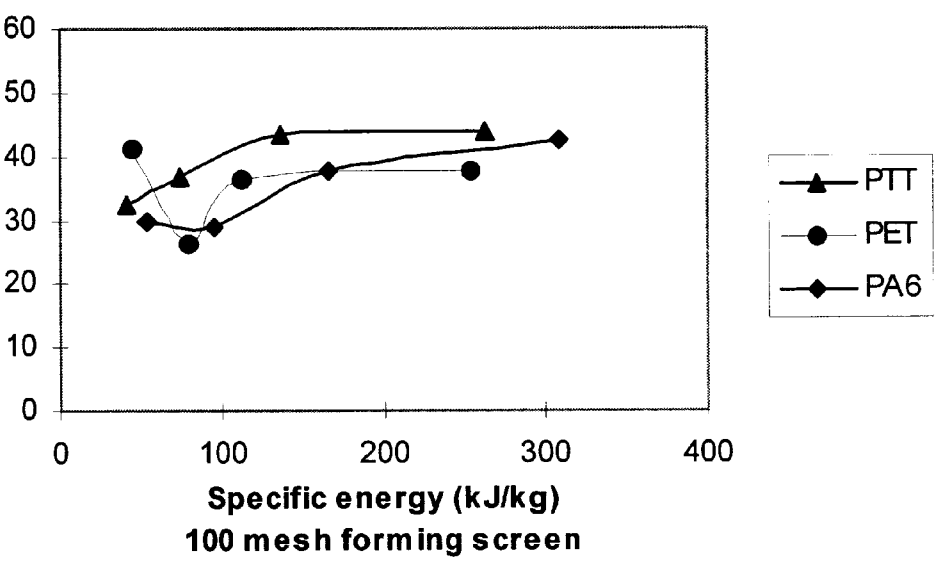
FIG. 13 shows the recovery of hydroentangled nonwovens from 10 percent strain as a function of forming energy.
Figure 13:
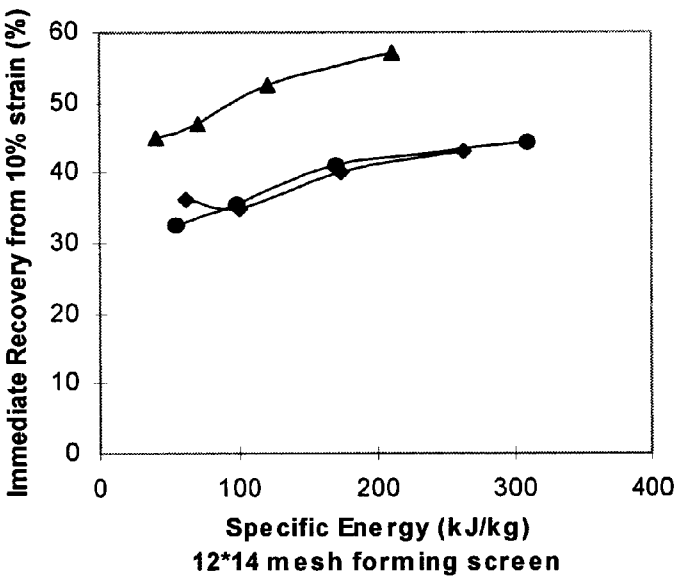

It can be seen that PTT offers a balance of low stiffness (approaching nylon) and high strength (approaching PET)

otherwise achievable only with fiber blends. The strength of the fabrics reflects the ability of the PTT fibers to interlace easily, rather than their inherent fiber strength. As a measure of their elasticity, these webs were examined for recovery from 10% strain, showing the PTT webs to have recovery beyond that of the other webs examined, as shown in FIG. 13.

COMPARATIVE EXPERIMENTS

During the course of these experiments, a roller top carding machine was used to card 100 percent PTT staples. This carding machine is commonly used for nonwovens. During this process, part of the web was carried by the roll and wrapped around them so the carding was unsuccessful. However, successful carding was achieved on the same machine using a staple blend of 90 percent PTT and 10 percent PET. Eight carded webs at 60 g/m$^2$ were successfully produced. An attempt was made to card the PTT stable on a Rando carding machine via the air laid method of carding. This was unsuccessful because the webs kept breaking and wrapping around the rolls.

The needle punch method of bonding the nonwovens was also tried. A Dilo machine with 90 punches per inch (228.6 punches per cm) was used and the experiments were carried out at 50, 100 (2 overlays), 150 (3 overlays) web weights and 7 millimeters in punch depth. The needle used was 15 (gauge) by 18 (taper related) by 32 (diameter related) by 3 inch (7.62 cm) (length). Based on tests by hand touch, the rank of softness is as follows and is similar to the rank for the hydroentangled webs listed above: PTT>nylon>PTT+50% PET>nylon+50% PET>PET. This test was not favorable because bonding strength was rather weak presumably due to the short staple used.

Five blends were investigated using the thermal bonding conditions shown in Table IX, 100 percent PET, 50/50 percent PET/nylon, 50/50 percent PET/PTT, nylon, and PTT. All experiments were run at 26.6 N/linear cm (300 pli) calendar row pressure, using a nominal 50 g/m$^2$ feed web. The PTT had a significantly greater shrinkage (basis weight gain) than the other blends.

The carded webs were thermal point bonded at temperatures per the following scheme (Table IX) all at 300 pli (26.6 N/linear cm) of pressure and line speed at 1.13 m/min.

TABLE IX

Calendar Bonding Conditions

| Variable | Range Investigated |
|---|---|
| Roll Pattern | Diamond |
| Bond Area | 25% |
| Speed | 1.13 m/min |
| Temperature | 100 to 225° C. |
| Pressure | 8.8 to 44.2 N/linear cm |

Table IX is an overall comparison of the properties of these thermal bonded blends. In thermal bonding, PTT produced, in general, fabrics which were significantly weaker in both tensile and tear than PET, nylon and PET/nylon blends.

TABLE X

Property Comparison of Thermal Point Bonded Fabrics

| Fiber | Lowest Temperature with BS > 30N or Highest Tested | Break Strength, N | Break Elongation, % | Flexile Rigidity, mg*cm | Tear Strength, N |
|---|---|---|---|---|---|
| PET | 225 | 48 | 35 | 750 | 26 |
| 50/50 PET/Nylon | 200 | 33 | 58 | 60 | 27 |
| 50/50 PET/PTT | 210 | 22 | 43 | 100 | 17 |
| Nylon | 190 | 41 | 38 | 5 | 25 |
| PTT | 195 | 5 | 36 | 110 | 3 |

We claim:

1. A method for making a nonwoven web from staple fibers of polytrimethylene terephthalate which comprises:

(a) making polytrimethylene terephthalate fibers having a cut length of from 10 to 200 millimeters and a fiber weight of 0.1 to 20 deniers per filament;

(b) carding the staple fibers at a belt speed of up to 1000 meters per minute, a cross lap of web of from 1 to 50 layers and a web weight of 5 to 500 g/m$^2$ in a carding machine selected from the group consisting of roller-top, flat-top, and layering types to produce a nonwoven web; and (c) mechanically bonding the web by hydroentanglement at a belt speed of up to 500 meters per minute with from 1 to 10 multiple passes and water jet hydraulic pressure of 1 bar to 500 bar (100 to 50000 kPa).

2. The method of claim 1 wherein the cut length in (a) is 25 to 80 mm and the fiber weight is 0.5 to 10 deniers per filament.

3. The method of claim 1 wherein the belt speed in (b) is from 10 to 1000 meters per minute.

4. The method of claim 2 wherein the belt speed in (b) is from 100 to 300 meters per minute, the cross lap is 3 to 10 layers, and the web weight is from 10 to 100 g/m$^2$.

5. The method of claim 1 wherein the belt speed is from 5 to 500 meters per minute.

6. The method of claim 2 wherein the belt speed is from 50 to 200 meters per minute with from 1 to 10 multiple passes and a water jet hydraulic pressure of 5 bar to 250 bar (500 to 25000 kPa).

* * * * *